US008025048B1

(12) United States Patent
Scarborough

(10) Patent No.: US 8,025,048 B1
(45) Date of Patent: Sep. 27, 2011

(54) PORTABLE OUTDOORS HEATER

(76) Inventor: David E. Scarborough, Macon, GA (US)

( * ) Notice: Subject to any disclaimer, the term of this patent is extended or adjusted under 35 U.S.C. 154(b) by 1152 days.

(21) Appl. No.: 11/744,217

(22) Filed: May 3, 2007

Related U.S. Application Data

(60) Provisional application No. 60/797,349, filed on May 3, 2006.

(51) Int. Cl.
*F24C 5/20* (2006.01)

(52) U.S. Cl. ..... 126/38; 126/9 R; 126/85 R; 126/92 AC; 126/110 B; 126/247; 431/331; 431/341

(58) Field of Classification Search ..... 126/247, 126/92 AC, 85 R, 110 B, 9 R, 266, 38; 432/222; 431/331, 341
See application file for complete search history.

(56) References Cited

U.S. PATENT DOCUMENTS

| | | | | |
|---|---|---|---|---|
| 59,397 | A | 11/1866 | Hutson | |
| 374,058 | A | 11/1887 | Gordon | |
| 706,097 | A | 8/1902 | Oney | |
| 2,975,828 | A | 3/1961 | Robson | |
| 3,101,770 | A | 8/1963 | Vant | |
| 3,274,901 | A * | 9/1966 | Yost | 91/392 |
| 3,730,165 | A * | 5/1973 | Williams | 126/266 |
| 3,933,145 | A | 1/1976 | Reich | |
| 4,013,396 | A | 3/1977 | Tenney | |
| 4,263,886 | A | 4/1981 | Batchelor | |
| 4,346,845 | A * | 8/1982 | Meyerhoff et al. | 239/418 |
| 4,351,314 | A | 9/1982 | Morton | |
| 4,372,287 | A | 2/1983 | Van Der Linden | |
| 4,719,877 | A | 1/1988 | Delage | |
| 4,758,153 | A | 7/1988 | Forster | |
| 4,784,599 | A | 11/1988 | Garbo | |
| 4,790,744 | A * | 12/1988 | Bellet et al. | 431/75 |
| 4,793,321 | A | 12/1988 | Rafford et al. | |
| 4,793,800 | A * | 12/1988 | Vallett et al. | 431/328 |
| 4,941,452 | A | 7/1990 | Thrasher et al. | |
| 5,002,481 | A | 3/1991 | Forster | |
| 5,098,283 | A | 3/1992 | Clapp | |
| 5,241,949 | A | 9/1993 | Collier | |
| 5,540,250 | A * | 7/1996 | Mullins | 137/77 |
| 6,129,078 | A | 10/2000 | Moulder | |
| 6,478,022 | B2 | 11/2002 | Robinson et al. | |
| 6,736,118 | B1 | 5/2004 | Velke | |
| 2002/0072020 | A1 | 6/2002 | Crane et al. | |
| 2004/0209206 | A1 | 10/2004 | Hockaday et al. | |
| 2004/0265758 | A1 | 12/2004 | Velke | |

* cited by examiner

*Primary Examiner* — Steven B McAllister
*Assistant Examiner* — Avinash Savani
(74) *Attorney, Agent, or Firm* — Robert L. Farris; Farris Law, P.C.

(57) ABSTRACT

The portable out door heater burns fuel such as propane from a pressurized gas fuel tank. The fuel enters an entrainment tube through a nozzle orifice that is coaxial with the cylindrical entrainment tube axis. Air enters the entrainment through air entry apertures and is entrained with the high velocity fuel stream. The air and fuel mixture passes from the entrainment tube into a coaxial cylindrical burner supply tube. The supply tube has a smaller diameter to accelerate movement of the air and fuel mixture. A cylindrical combustion chamber receives the air fuel mixture moving tangentially to the combustion chamber inside wall. A ring inside the chamber retards movement of the fuel charge. The fuel oxidizes at a temperature that reduces odors and converts carbon monoxide to carbon dioxide. The products of combustion pass through a silencer and into an area to be heated. A choke and igniter initiate combustion.

11 Claims, 9 Drawing Sheets

PORTABLE OUTDOORS HEATER

This application claims the benefit of the filing date of U.S. Provisional Application No. 60/797,349 titled PORTABLE OUTDOORS HEATER filed May 3, 2006.

TECHNICAL FIELD OF THE INVENTION

The heater for outdoorsman burns a pressurized fuel gas such as propane, butane, or the like, in a combustion chamber with a large volume of naturally aspirated air, a small gas flow rate, and discharges products of combustion with low levels of carbon monoxide, nitrogen oxides and odors.

BACKGROUND OF THE INVENTION

Outdoorsman during periods of low ambient temperatures need a heat source to maintain body temperature. This is particularly true when confined to a small area, such as a blind, a tree stand or a water craft. A person trying to photograph a moose for example, in it's natural habitat is unlikely to see the animals if the animals can see, hear or smell the outdoorsman's presence. Heat sources that burn fuel and are currently available, produce odors, and noise that a moose can detect from a distance. The scents and noise often keep animals away from view by the outdoorsman.

Fuel burners generally produce high concentrations of carbon monoxide. This deadly gas overcomes a few outdoorsmen each year.

SUMMARY

The portable outdoor heater includes an inlet gas line adopted to be connected to a pressurized gas fuel tank. An adjustable fuel flow rate control valve in the inlet gas line controls the flow of gas from the pressurized gas fuel tank. A gas nozzle is mounted in a discharge end of the inlet gas line. An entrainment tube has an entrainment tube axis, an inlet end, an air entrainment section with four slots with slot long axes that are parallel to the entrainment tube axis, a gas and air mixing section, and a mixed gas and air discharge end. A nozzle support bushing in the inlet end of the entrainment tube supports the gas nozzle with a nozzle orifice coaxial with the entrainment tube axis. A burner supply tube is fixed to the mixed gas and air discharge end of the entrainment tube. The burner supply tube is coaxial with the entrainment tube axis. The burner supply tube cross section area that is smaller than an entrainment tube cross section area to increase the velocity of mixed gas and air passing through the burner supply tube.

A tubular combustion chamber is attached to the burner supply tube to receive mixed gas and air, from the burner supply tube, tangentially to a tubular combustion chamber cylindrical inside wall surface. The combustion chamber includes a closed end, a combustion chamber discharge end, and a ring member fixed to the combustion chamber cylindrical inside wall surface between the burner supply tube and the combustion chamber discharge end. A central aperture through the ring member is concentric with the tubular combustion chamber axis. The ring member retards the movement of gases from the combustion chamber.

A choke with a choke sleeve telescopically received on the inlet end of the entrainment tube. The choke sleeve is slidable relative to the entrainment tube between a position covering the slots and a position in which the slots are uncovered. The slots are covered to provide excess fuel in the air and fuel mixture to initiate combustion. A coil spring is telescopically received on the entrainment tube. The spring urges the choke sleeve toward the position in which the slots in the entrainment tube are uncovered for air entry. An igniter extends into the burner supply tube and is activated to initiate combustion.

A silencer is connected to the combustion chamber discharge end. A silencer discharge passage passes products of combustion into an area outside the heater that is to be heated.

The portable outdoor heater includes an inner core. The inner core has core side walls and a core bottom wall that contain the silencer. An outer shell of the heater is spaced from the core side walls and the core bottom wall. Cooling air apertures in the outer shell permit the ingress of cooling air. Egress apertures in the outer shell top wall provide passages for the passage of hot products of combustion from the silencer and heated cooling air into the area to be heated.

BRIEF DESCRIPTION OF THE DRAWINGS

These and other objects, features and advantages will become more readily apparent in view of the following detailed description and best mode, and accompanying drawings, in which.

DETAILED DESCRIPTION OF THE PREFERRED EMBODIMENT

Figure 1:
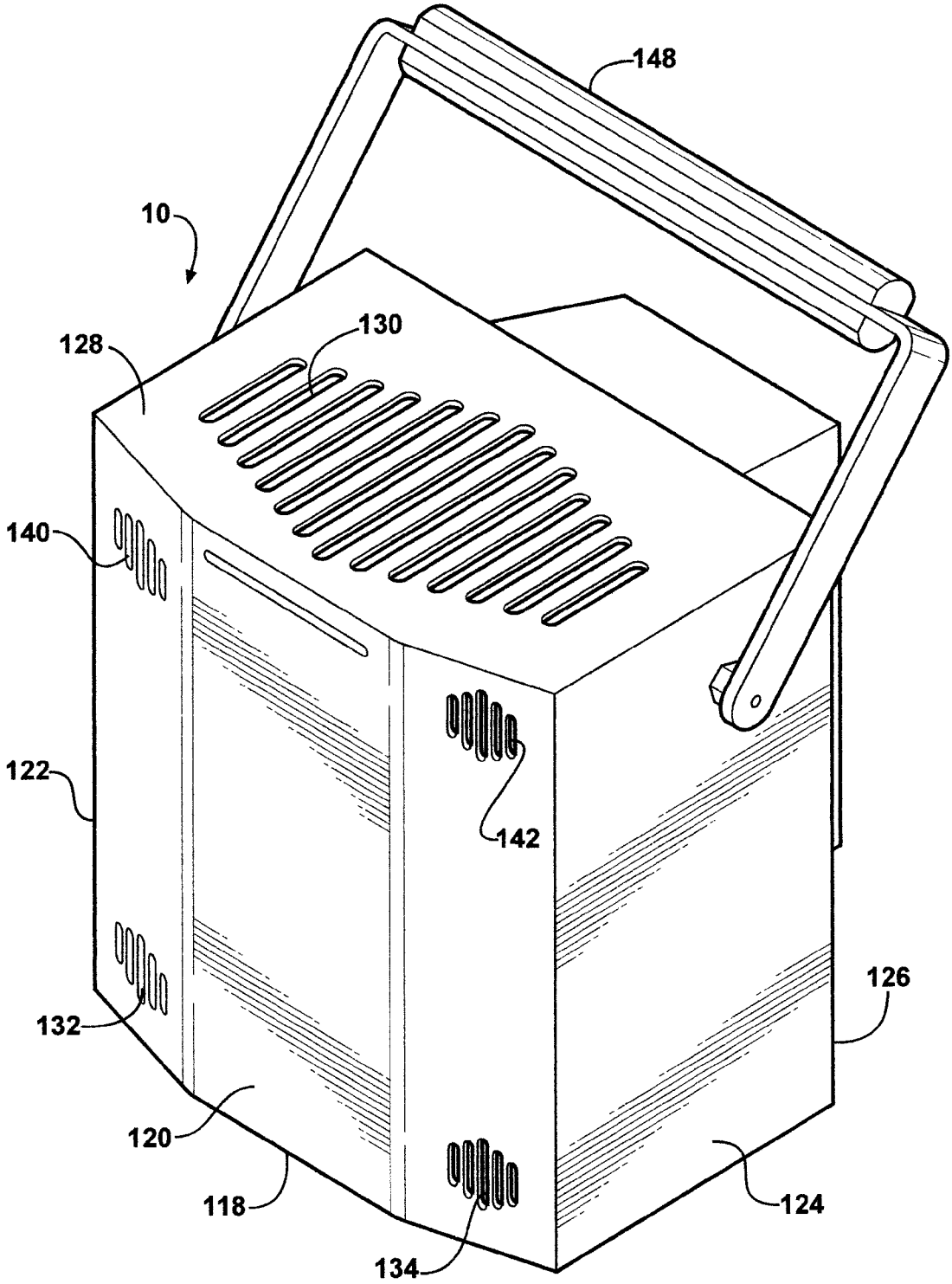
FIG. 1 is a perspective view of the heater.
Figure 2:
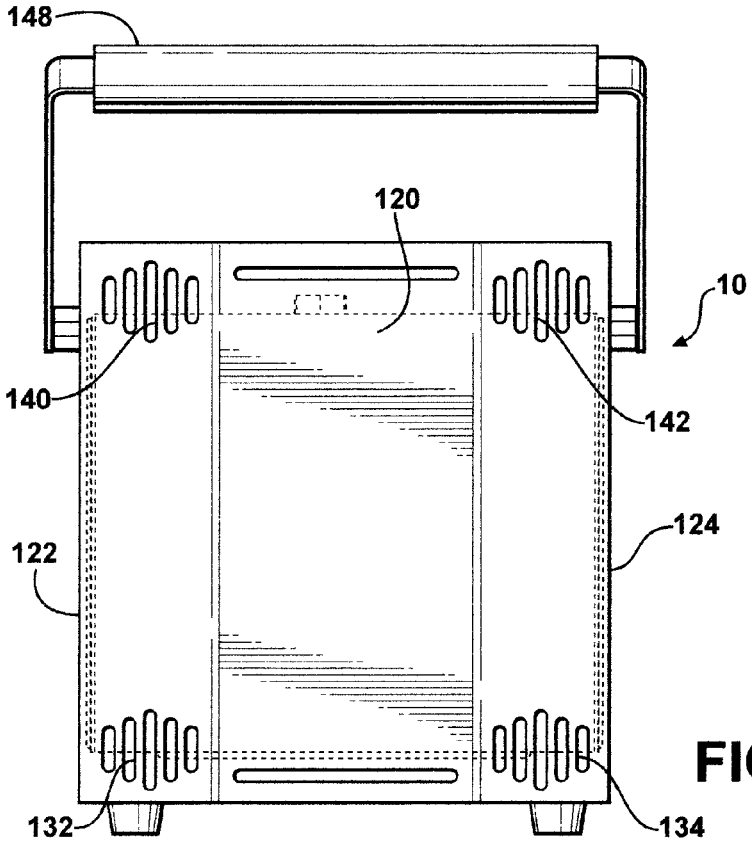
FIG. 2 is a front elevational view of the heater.
Figure 3:
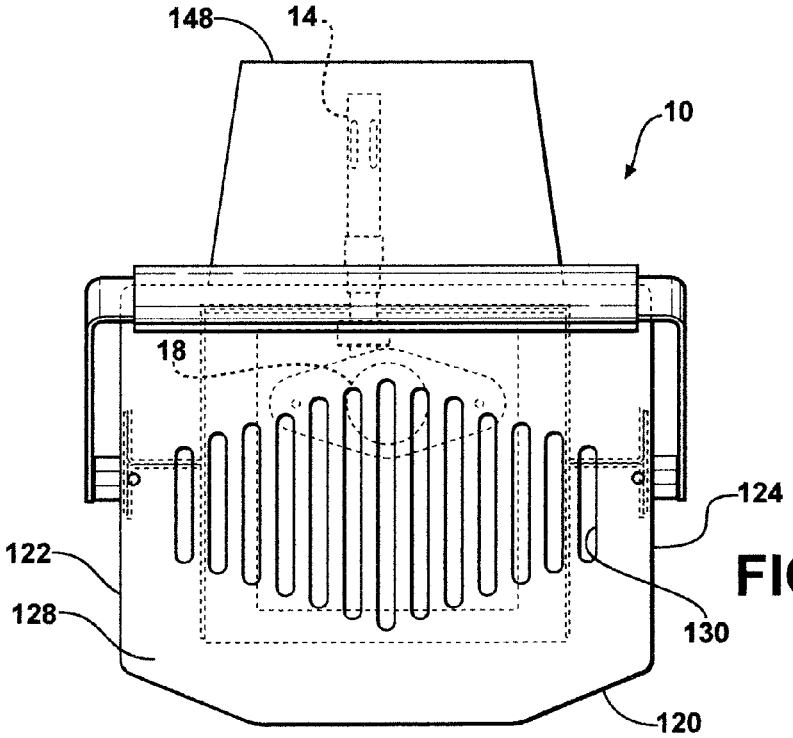
FIG. 3 is a top plan view of the heater.
Figure 4:
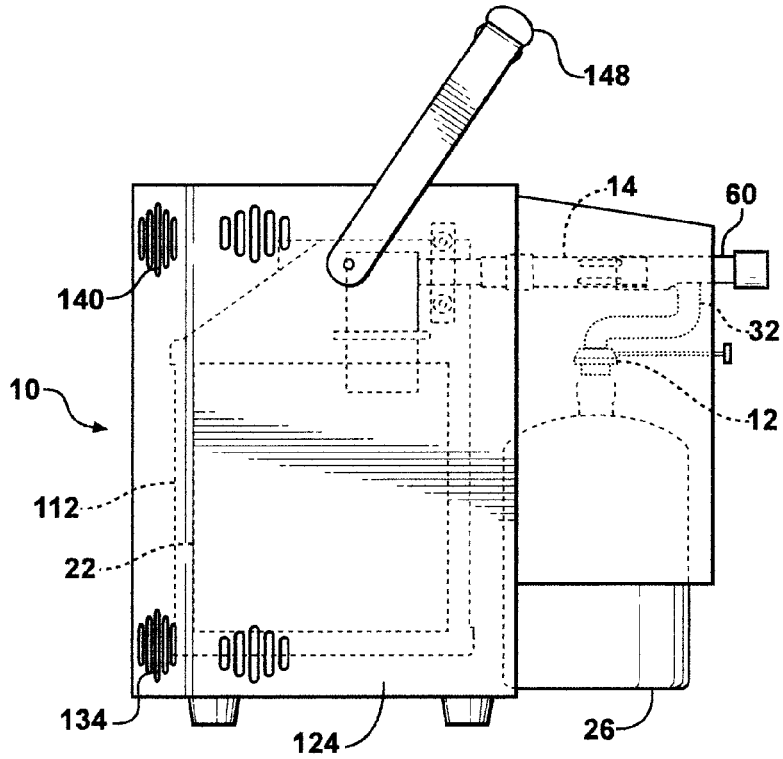
FIG. 4 is a side elevational view of the heater.

The heater 10 includes a fuel valve 12 an air entrainment tube 14 an igniter 16, a combustion chamber 18, a silencer 22 and an exhaust gas discharge apertures 110. The fuel valve controls the flow of propane or other fuel from a pressure vessel 26. Valves are commercially available to turn off and on, adjust the fuel flow rate and include a thermocouple that closes the valve if the oxidation process ceases. Fuels such as liquefied natural gas can be used in place of the propane.

The fuel valve 12 is adjustable to control the flow rate of fuel passing through a fuel orifice 30. The orifice 30 is on the end of a fuel line 32 that is connected to the discharge aperture of the fuel valve 12. The fuel valve 12 is closed to stop the flow of fuel through the orifice 30. The fuel valve 12 is opened to permit the passage of fuel from the fuel orifice 30.

The orifice 30 is positioned well inside the entrainment tube 14 and is coaxial with an axis 28 of the entrainment tube 14. A bushing 24 holds the orifice 30 of a nozzle 31 in axial alignment with the entrainment tube axis 28. Four slots 34 are provided in the wall 36 of the cylindrical air entrainment tube 14. The long axis of each of the slots 34 is parallel to the direction of movement of fuel through the air entrainment section of the entrainment tube 14 and the entrainment axis 28. The motive force of gaseous fuel passing from the fuel orifice 30 entrains air entering the entrainment tube 14 through the slots 34 and carries the air with the gaseous fuel toward the combustion chamber 18. A fan or blower is not required to move air and gaseous fuel into the combustion chamber 18.

The entrainment tube 14 is connected to a coaxial burner supply tube 27 by a reducing coupler 29. The purpose of the reduced diameter of the burner supply tube 27 is to accelerate the velocity of the gaseous fuel and the entrained air to prevent flashback.

An igniter 16 is mounted on the burner supply tube 27. A spark producing electrode assembly 42 of the igniter extends radially inward toward the axis 28 of the entrainment tube 14.

The reduced diameter burner supply tube 27 passes the burning mixture of gaseous fuel and entrained air through the discharge end 38, and into the combustion chamber 18 moving in a path generally tangential to the cylindrical inside surface 44 of the combustion chamber. The combustion chamber 18 has a plate 58 closing one end. The other end 56 is open. The tangential flow of air and gaseous fuel results in a swirling movement which mixes the air and fuel thereby improving the burning efficiency. The swirling flow is employed to stabilize the flame due to the low fuel-air ratio used. The fuel in the swirling flow is burned within the combustion chamber 18. A ring 50 is fixed to the inside wall surface 44 of the combustion chamber 18. A central aperture 54 through the ring 50 reduces the area through which the hot products of combustion must pass to exit the combustion chamber 18. The purpose of the ring is to slow the movement of burning gaseous fuel and air through the combustion chamber 18. Slowing the movement keeps most of the oxidation process upstream from the ring 50. A temperature increase is obtained in the combustion chamber 18. The production of carbon monoxide is minimized due to the high temperature, and excess air and the oxygen in the air in the combustion chamber 18.

Figure 11:
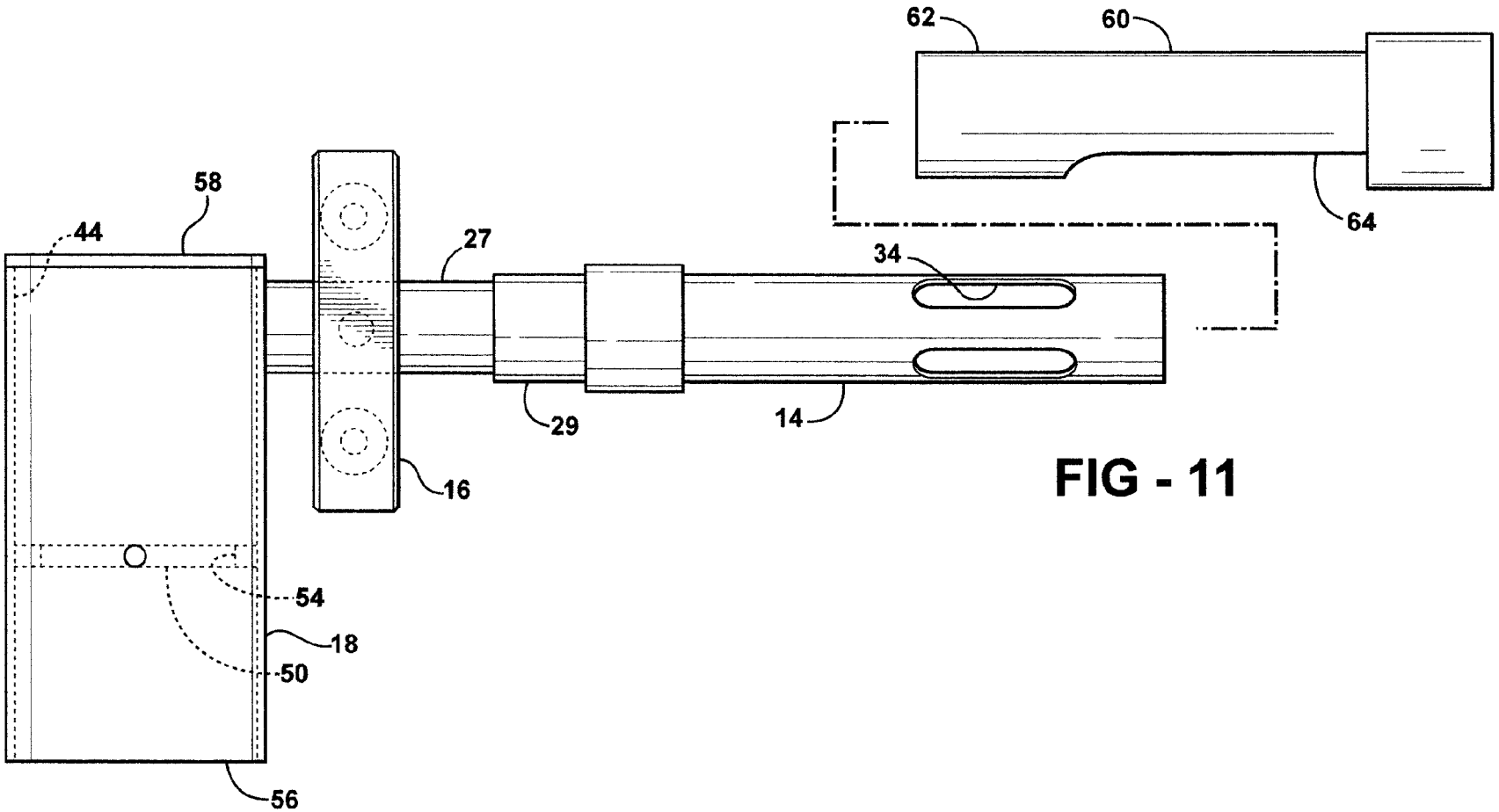
FIG. 11 is an enlarged expanded elevational view of the combustion chamber, the air entrainment tube and choke.

Ignition of the gaseous fuel and the entrained air can be difficult with the low fuel-air ratio and ambient temperature. To start the heat generation process, the fuel flow rate setting of the fuel valve 12 is turned to a maximum flow rate setting. A choke 60 is moved to a position in which a portion of the air flow of combustion air through the slots 34 and into entrainment tube 14 is blocked to create a higher fuel-air ratio. The choke 60 includes a cylindrical sleeve 62 that telescopically receives the cylindrical entrainment tube 14. A slot 64 in the choke provides a passage for the fuel line 32. A coil spring 66 is mounted on the entrainment tube 14, seats on the reducing coupler 29 and urges the choke 60 toward an off position. Sliding the cylindrical sleeve 62 to the left from the position shown in FIG. 11 blocks the flow of air to the slots 34. Moving the sleeve 62 to the right uncovers the slots 34 and frees the slots to receive additional air and reduces the fuel-air ratio. After the choke 60 is set for start-up and the fuel valve is set on the maximum flow rate setting, and the electrical igniter 16 is activated. After the igniter 16 is on, the fuel valve 12 is opened. Once fuel is ignited, the igniter 16 may be deactivated. The sleeve 62 of the choke 60 is moved by a coiled compression spring to a position in which additional air can enter the entrainment tube 14 through the slots 34. The fuel valve 12 is adjusted to provide the desired fuel flow rate.

A thermal sensor is mounted in or on the combustion chamber to determine if the fuel is burning. If the flame goes out the thermal sensor closes the fuel valve 12. The flame can not be observed in the stainless steel combustion chamber 18 unless there is a special viewing window or aperture.

Figure 8:
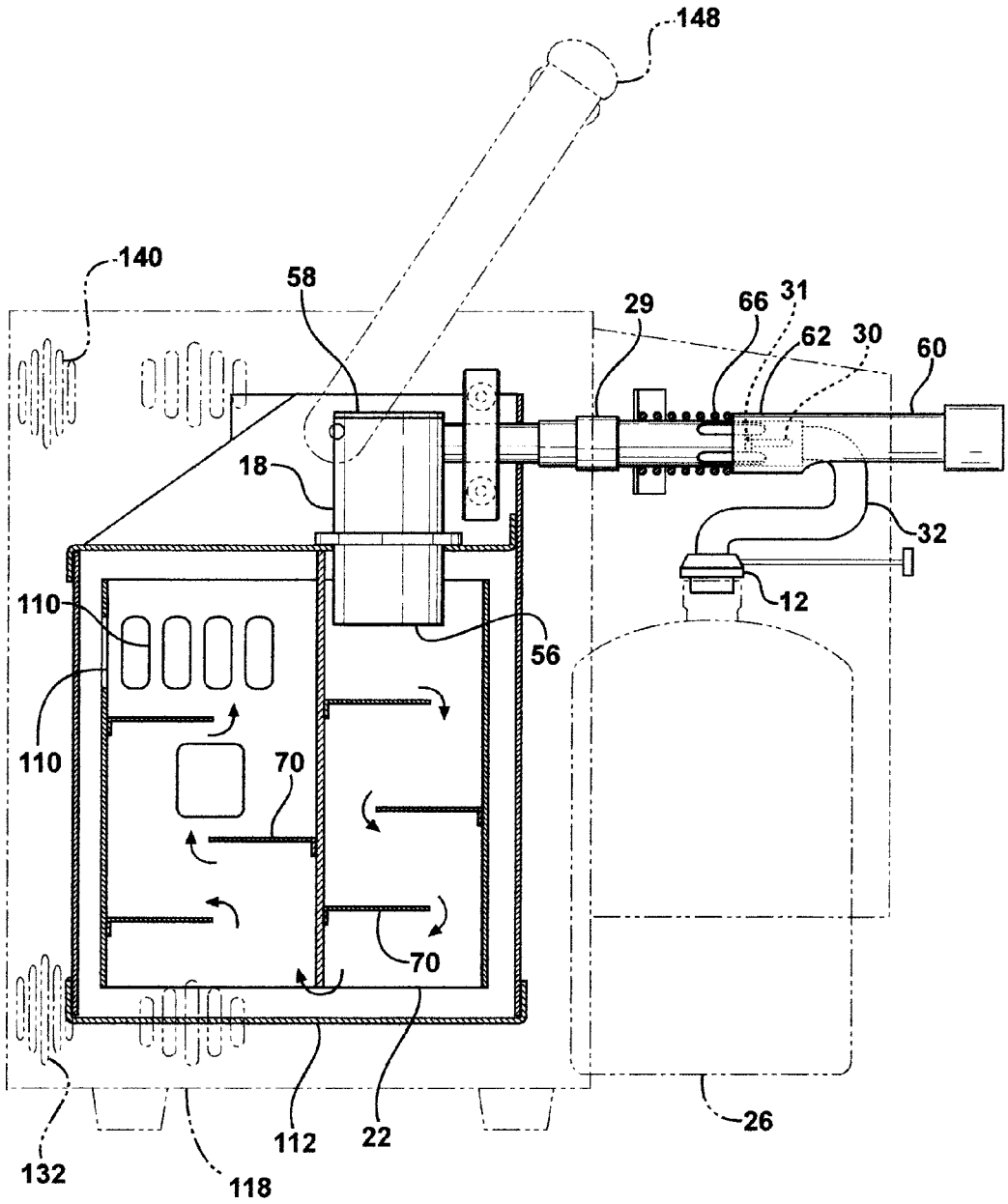
FIG. 8 is a vertical side sectional view of the inner core with the outer shell in phantom lines.
Figure 9:
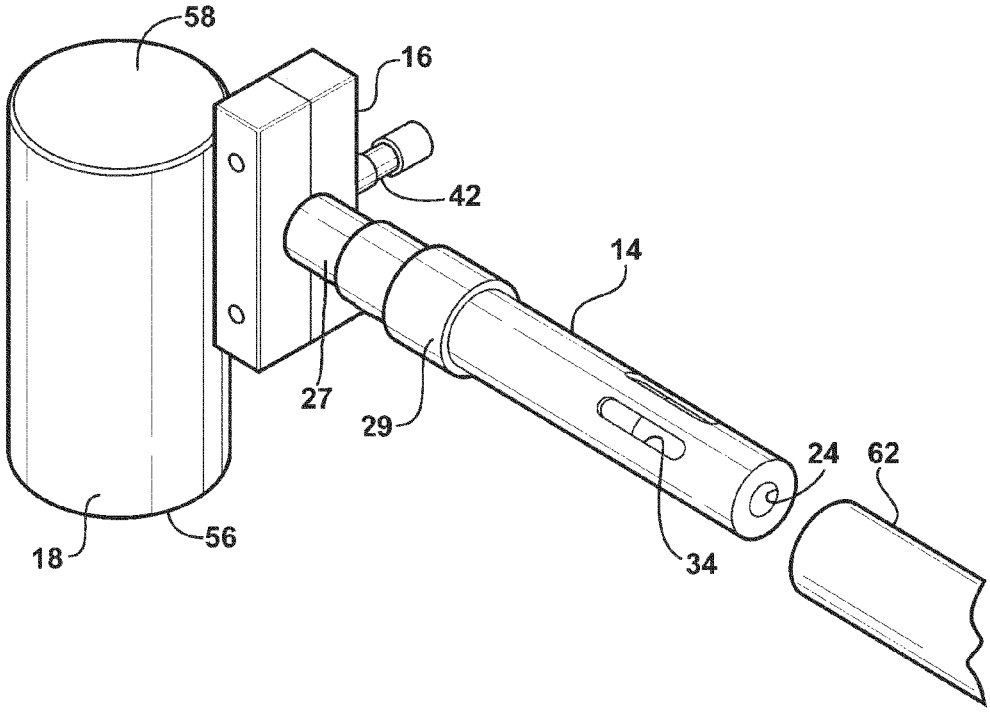
FIG. 9 is an enlarged perspective view of the combustions chamber and the air entrainment tube.
Figure 10:
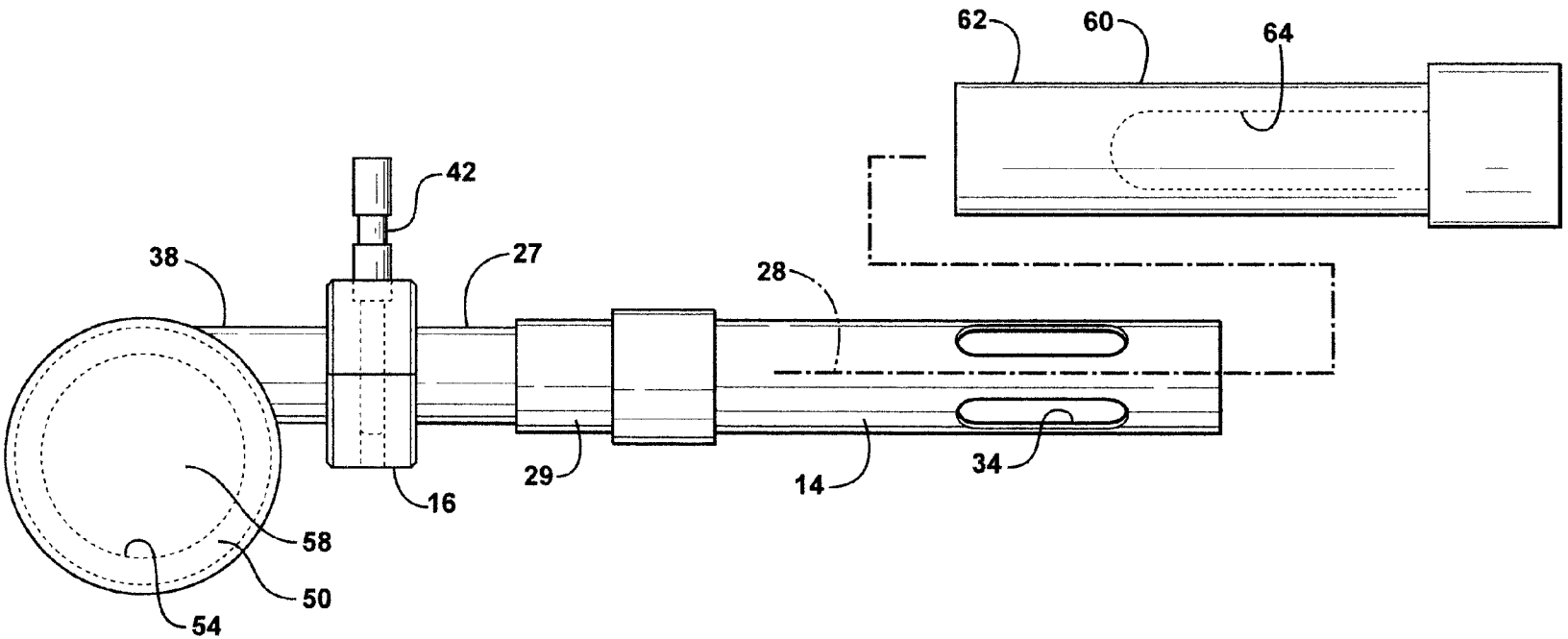
FIG. 10 is an enlarged expanded plan view of the combustion chamber and the air entrainment tube and choke.

The hot gasses heat the walls 44 of the combustion chamber 18 and move from the combustion chamber 18 to the silencer 22 as indicated by the arrows in FIG. 8. The walls of the silencer 22 are also heated. Heat is transferred from the outside surface of the combustion chamber 18 and the silencer 22 by thermal radiation and by convection to heat surrounding space.

The products of combustion pass from the combustion chamber 18 to a silencer 22. Gasses in the silencer 22 pass around baffles 70. The walls of the silencer 22 and the baffles 70 may be covered by sound deadening material. Some sound deadening material may also be mounted on the inside walls of the silencer 22 in locations where the heat transfer will not be adversely affected. Products of combustion discharged from the silencer 22 may be filtered by a charcoal exhaust gas filter to further reduce scents.

Figure 5:
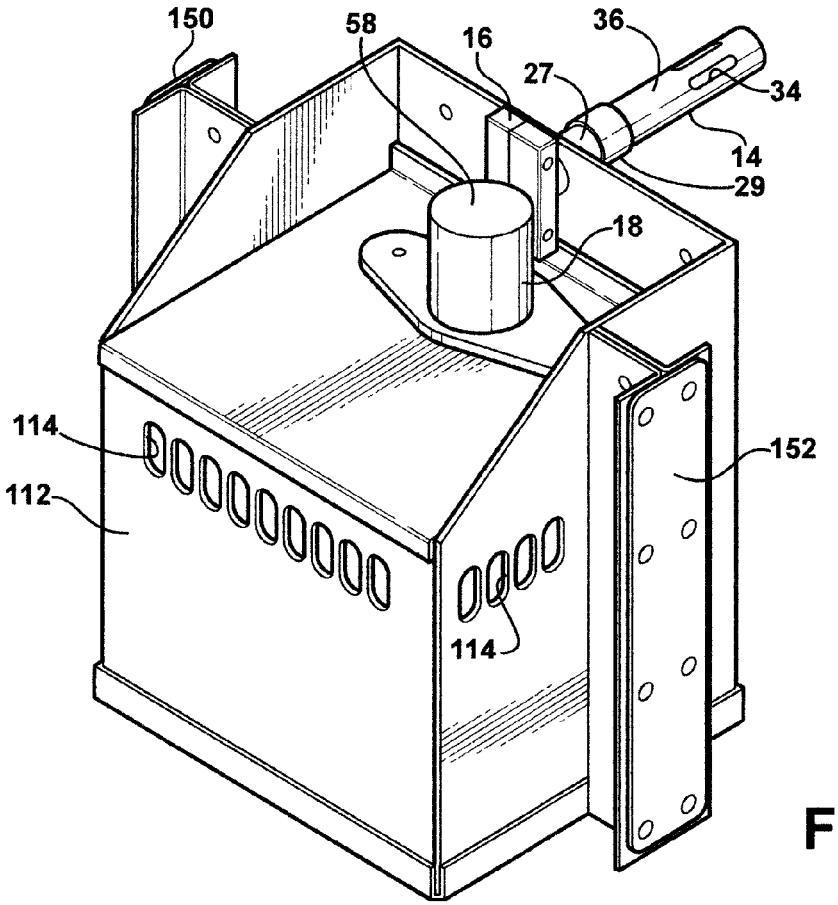
FIG. 5 is a perspective view of the inner core including the air entrainment tube, the igniter, the combustion chamber and the silencer.
Figure 6:
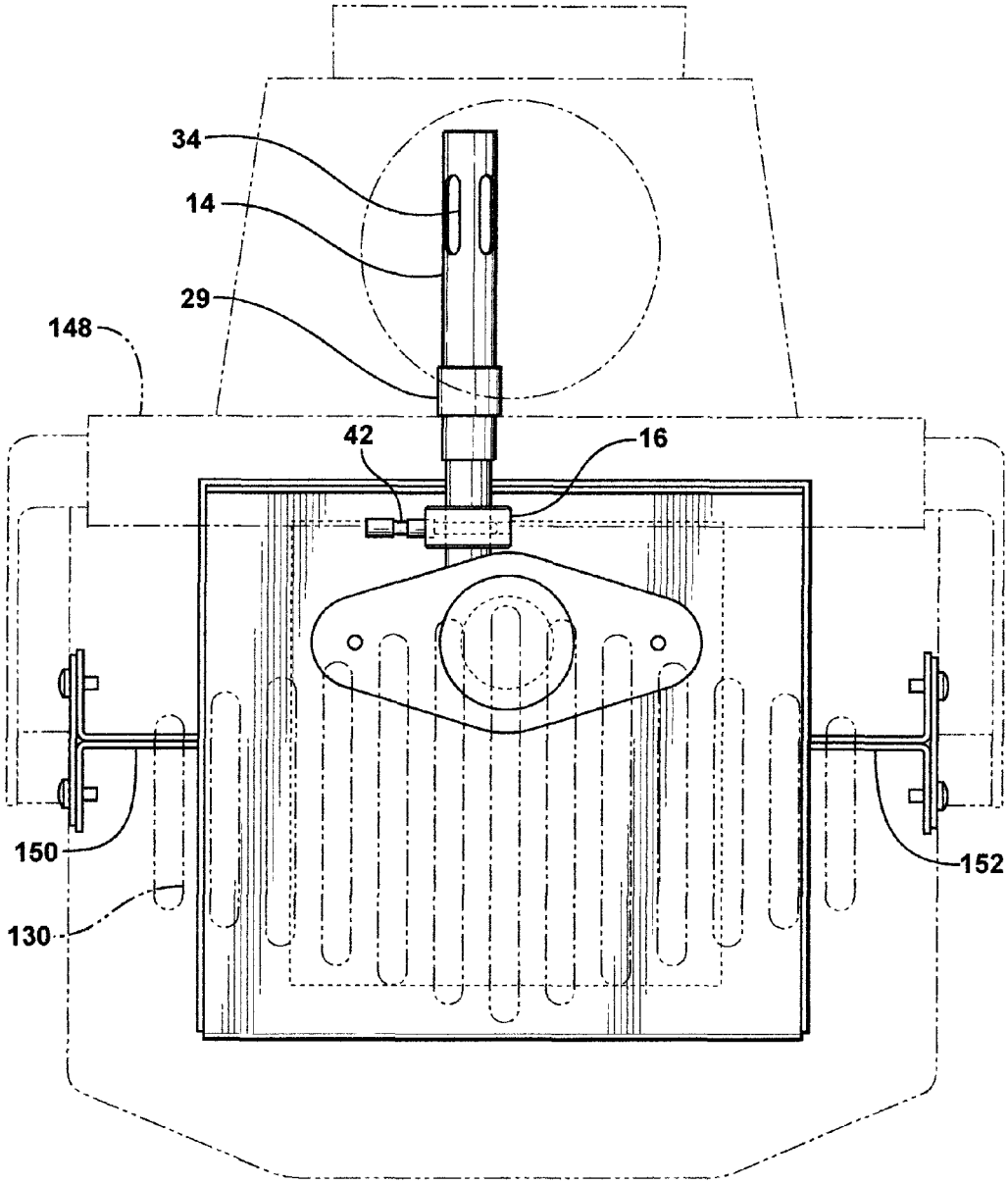
FIG. 6 is a top plan view of the inner core and the outer shell in phantom lines.
Figure 7:
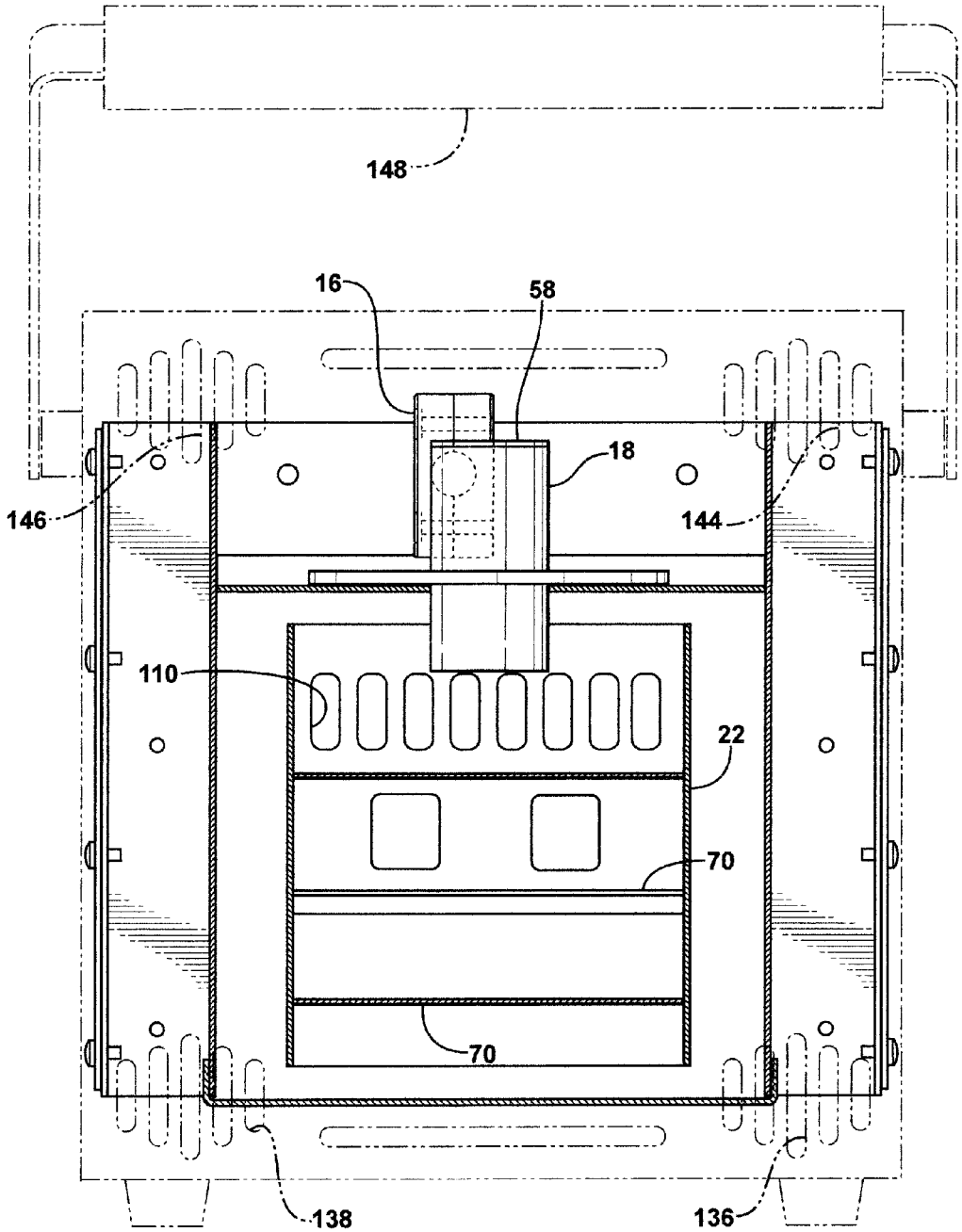
FIG. 7 is a vertical front sectional view of the inner core with the outer shell in phantom lines and with partitions and baffles removed.

Hot gas exits the silencer 22 through apertures 110 and into the inner core 112. Hot gases exit the inner core 112 through apertures 114 shown in FIG. 5. An outer shell 116 is secured to the flanges 150 and 152 on the inner core 112. The outer shell 116 includes a bottom wall 118, a front wall 120 side walls 122 and 124, a rear wall 126 and a top wall 128. The hot products of combustion exit the outer shell through apertures 130 in the top wall 128. Cooling air enters the outer shell 116 through apertures 132, 134, 136 and 138. The cooling air cools the bottom and side walls of the inner core 112 and is heated. The heated cooling air rises and passes through wall apertures 140, 142, 144 and 146 and heats an area outside the heater 10. Some heated cooling air also passes from outer shell 116 through the apertures 130 in the top wall 128.

A carrying handle 148 is pivotally attached to the outer side walls 122 and 124 of the outer shell 116 as well as the flanges 150 and 152 on the inner core 112.

The combustion process is confined in a combustion chamber 18 that is protected from rain, snow and wind. The system operates with a fuel-air ratio typical of very high efficiency, low-emissions burners. Existing portable space heaters are not capable of sustaining combustion at lean fuel-air ratios obtained with the burned described above. The heater 10 produces less odor than existing space heaters. The levels of emissions of carbon monoxide and oxides of nitrogen are lower than found in portable heaters with existing technologies. In a closed box test levels of carbon monoxide and levels of oxides of nitrogen remained low until the oxygen available for combustion was substantially depleted.

Carbon monoxide (CO) discharged from space heaters is a potential problem as stated above. In a comparison test, a new propane heater was tested across a range of power settings. CO levels were measured within ¼ inch (close) of the burner face and about one inch (far) from the burner face. The average close measurement for CO was 219 parts per million (ppm). The average far measurement was 176 ppm. The average CO measurement for the prototype burner shown in FIG. 1 was 9.4 ppm. Under the same test conditions as the new propane heater.

In a closed box test of the prototype burner shown in FIG. 1, it was noted that CO levels remained low until oxygen levels in the box were low. An oxygen depletion sensor near the air passage to the slots 34 in the air entrainment tube 14, detects low oxygen levels in the area in which the heater 10 is housed. Upon sensing a drop in the oxygen level in air entering the air entrainment tube 14, an audible alarm is activated to alert individuals in the area housing the heater that oxygen levels have dropped to a level at which fresh air needs to be admitted into the area. The quantity of CO generated by the heater 10 is at a level at which oxygen depletion is a primary concern and CO levels are of less concern.

I claim:

1. A portable outdoor heater comprising:

an inlet gas line adapted to be connected to a pressurized gas fuel tank, an adjustable fuel flow rate control valve couple to the inlet gas line that controls the flow of gas from the pressurized gas fuel tank, and a gas nozzle in a discharge end of the inlet gas line;

an entrainment tube with an entrainment tube axis, an inlet end fitted with a choke, an air entrainment section with a plurality of air entry apertures, a gas and air mixing section and a mixed gas and air discharge end;

a nozzle support in the inlet end of the entrainment tube that supports the gas nozzle with a nozzle orifice coaxial with the entrainment tube axis;

a burner supply tube fixed to the mixed gas and air discharge end of the entrainment tube, coaxial with the entrainment tube axis, and having a burner supply tube cross section area that is smaller than an entrainment tube cross section area;

an igniter extending into the burner supply tube;

a tubular combustion chamber attached to a supply tube discharge end of the burner supply tube to receive mixed gas and air from the burner supply tube tangentially to a tubular combustion chamber inside wall surface, and including a combustion chamber closed end, a combustion chamber discharge end, a ring member fixed to the combustion chamber inside wall surface between the burner supply tube discharge end and the combustion chamber discharge end, a central aperture through the ring member that is concentric with a tubular combustion chamber axis, a ring member surface facing toward the combustion chamber closed end and extending generally perpendicular to and away from the combustion chamber inside wall surface to the central aperture and wherein the ring member surface facing toward the combustion chamber closed end is spaced from and parallel to the entrainment tube axis;

wherein a mixture of gas and air discharged from the burner supply tube is guided by the tubular combustion chamber inside wall surface and rotates around the tubular combustion chamber axis;

wherein a gas in the mixture of gas and air is held in the combustion chamber by the ring member surface facing toward the combustion chamber closed end until the gas is fully burned in the combustion chamber; and a silencer connected to the combustion chamber discharge end and including a silencer discharge passage that passes products of combustion into an area that is to be heated.

2. A portable outdoor heater as set forth in claim 1, wherein the a choke has with a choke sleeve telescopically received on the inlet end of the entrainment tube and slidable relative to the entrainment tube between a position covering the plurality of air entry apertures and a position in which the plurality of air entry apertures are uncovered.

3. A portable outdoor heater, as set forth in claim 2, including a coil spring that urges the choke sleeve toward the position in which the plurality of air entry apertures are uncovered.

4. A portable outdoor heater, as set forth in claim 1, wherein the plurality of air entry apertures include at least three slots with slot long axes that are parallel to the entrainment tube axis.

5. A portable outdoor heater, as set forth in claim 4, including an igniter extending into the burner supply tube.

6. A portable outdoor heater, as set forth in claim 1, wherein the tubular combustion chamber is cylindrical.

7. A portable outdoor heater, as set forth in claim 1, including an inner core with core side walls and a core bottom wall and an outer shell spaced from the core side walls and the core bottom wall and cooling air apertures in the outer shell for the ingress of cooling air, and egress apertures in an outer shell top wall for the passage of hot products of combustion from the silencer and heated cooling air.

8. A portable outdoor heater comprising:

an inlet gas line adapted to be connected to a pressurized gas fuel tank, an adjustable fuel flow rate control valve in the inlet gas line that controls the flow of gas from the pressurized gas fuel tank, and a gas nozzle in a discharge end of the inlet gas line;

an entrainment tube with an entrainment tube axis, an inlet end, an air entrainment section with at least three air entry slots with slot long axes that are parallel to the entrainment tube axis, a gas and air mixing section and a mixed gas and air discharge end;

a nozzle support in the inlet end of the entrainment tube that supports the gas nozzle with a nozzle orifice coaxial with the entrainment tube axis;

a burner supply tube fixed to the mixed gas and air discharge end of the entrainment tube, coaxial with the entrainment tube axis and having a burner supply tube cross section area that is smaller than an entrainment tube cross section area;

a tubular combustion chamber attached to the burner supply tube to receive mixed gas and air, from the burner supply tube, tangentially to a tubular combustion chamber cylindrical inside wall surface, and including a combustion chamber closed end, a combustion chamber discharge end, and a ring member fixed to the combustion chamber cylindrical inside wall surface between the burner supply tube and the combustion chamber discharge end, and a central aperture through the ring member that is concentric with a tubular combustion chamber axis, wherein the ring member includes a ring surface that faces toward the combustion chamber closed end, the ring surface that faces toward the combustion chamber closed end is perpendicular to the tubular combustion chamber axis, and wherein the ring surface that faces toward the combustion chamber closed end is spaced from and parallel to the entrainment tube axis;

wherein a tube diameter length of the burner supply tube is less than a combustion chamber radius length of the tubular combustion chamber cylindrical inside wall surface;

a choke with a choke sleeve telescopically received on the inlet end of the entrainment tube and slidable relative to the entrainment tube between a position covering the at least three slots and a position in which the at least three air entry slots are uncovered for air entry;

an igniter extending into the burner supply tube; and a silencer connected to the combustion chamber discharge end and including a silencer discharge passage that passes products of combustion into an area that is to be heated.

9. A portable outdoor heater, as set forth in claim 8, including an inner core with core side walls and a core bottom wall and an outer shell spaced from the core side walls and the core bottom wall and cooling air apertures in the outer shell for the ingress of cooling air, and egress apertures in an outer shell top wall for the passage of hot products of combustion from the silencer and heated cooling air.

10. A portable heater comprising:

an inlet gas line adapted to be connected to a pressurized gas fuel tank, an adjustable fuel flow rate control valve in the inlet gas line that controls the flow of gas from the pressurized fuel gas tank, and a gas nozzle in a discharge end of the inlet gas line;

an entrainment tube with an entrainment tube axis, an inlet end, an air entrainment section with at least one air entry aperture, a gas and air mixing section and a mixed gas and air discharge end;

a choke with a choke sleeve telescopically received on the inlet end of the entrainment tube and slidable relative to the entrainment tube between a position covering the air entry aperture of the entrainment tube and a position that uncovers the air entry apertures of the air entrainment tube;

a nozzle support in the inlet end of the entrainment tube that supports the gas nozzle with at least one nozzle orifice that is coaxial with the entrainment tube axis;

a burner supply tube fixed to the mixed gas and air discharge end of the entrainment tube, coaxial with the entrainment tube axis, and having a burner supply tube cross section area that is smaller than an entrainment tube cross section area;

an igniter extending into the burner supply tube; and a tubular combustion chamber attached to the burner supply tube to receive mixed gas and air from the burner supply tube tangentially to a tubular combustion chamber inside wall surface, and including a combustion chamber closed top end, a combustion chamber bottom discharge end, and a ring member fixed to the combustion chamber inside wall surface between the burner supply tube and the combustion chamber bottom discharge end, a central aperture through a top face the ring member that is concentric with a tubular combustion chamber axis, and wherein the ring member has top ring surface that faces toward the combustion chamber closed top end and the top ring surface is perpendicular to the tubular combustion chamber axis.

11. A portable heater, as set forth in claim 10, including a silencer connected to the combustion chamber bottom discharge end and including a silencer discharge passage that passes products of combustion into an area that is to be heated.

* * * * *